US006161480A

United States Patent [19]

Pfizenmaier

[11] Patent Number: 6,161,480

[45] **Date of Patent: *Dec. 19, 2000**

[54] CONTROL DESK FOR A PRINTING PRESS WITH A DEVICE FOR PRODUCING PRINTING FORMS

[75] Inventor: Wolfgang Pfizenmaier, Neckargemuend, Germany

[73] Assignee: Heidelberger Druckmaschinen AG, Heidelberg, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 09/165,874

[22] Filed: Oct. 2, 1998

[30] Foreign Application Priority Data

Oct. 5, 1997 [DE] Germany ..... 197 43 819

[51] Int. Cl.[7] ..... B41N 3/00

[52] U.S. Cl. ..... 101/477; 101/463.1; 101/467

[58] Field of Search ..... 101/365, DIG. 43, 101/463.1, 464, 465, 466, 467, 468, 469, 470, 471, 472, 473, 401.1, 117, 477

[56] References Cited

U.S. PATENT DOCUMENTS

| | | | |
|---|---|---|---|
| 3,781,109 | 12/1973 | Mayer, Jr. et al. | 355/52 |
| 4,007,362 | 2/1977 | Sindermann | 235/151 |
| 4,495,582 | 1/1985 | Dessert et al. | 364/469 |
| 4,803,634 | 2/1989 | Ohno et al. | 364/478 |
| 4,919,045 | 4/1990 | Okubo et al. | 101/142 |
| 5,528,377 | 6/1996 | Hutcheson | 358/298 |
| 5,875,288 | 2/1999 | Bronstein et al. | 395/109 |
| 5,887,525 | 3/1999 | Okamura et al. | 101/463.1 |
| 6,076,464 | 6/2000 | Okamura | 101/463.1 |
| 6,079,331 | 6/2000 | Koguchi et al. | 101/467 |

FOREIGN PATENT DOCUMENTS

| | | |
|---|---|---|
| 38 35 107 | 4/1989 | Germany . |
| 40 41 430 | 7/1991 | Germany . |
| 43 06 677 | 1/1995 | Germany . |
| 2 275 655 | 5/1996 | United Kingdom . |

*Primary Examiner*—Daniel J. Colilla
*Attorney, Agent, or Firm*—Kenyon & Kenyon

[57] ABSTRACT

A device (14) for production of printing forms is integrated into a control desk (4) which has operating and display elements (20, 21) for the control of operating processes of a printing press (2, 3). The device can be used in print shops in which production of printing forms and printing itself are closely linked on the basis of operation sequences.

7 Claims, 1 Drawing Sheet

CONTROL DESK FOR A PRINTING PRESS WITH A DEVICE FOR PRODUCING PRINTING FORMS

FIELD OF THE INVENTION

The present invention relates generally to printing presses and more particularly to a control desk for a printing press.

RELATED TECHNOLOGY

The structural combination of operating and display elements with a printing press is known in printing presses and printing equipment with only a small number of operating processes to be controlled. Printing presses with a considerable range of functions as a rule are provided with one or more control desks. A user-friendly control desk is constructed in the form of a table with input and display elements situated at working height. Delivery surfaces can be provided on the control desk for matching of print samples and for comparison with master copies as well as auxiliary supports for a vertical arrangement of the samples. In the control desk itself, power supply units, signal processing elements, and control elements are housed so as to be essentially shockproof. Inputs and outputs in the form of plugs, receptacles, and the like are provided on the control desk for connections for signaling means and for power supply. In print shops with a print-shop control system, computer means are provided which can be connected with the print shop's computer network.

Also known are control desks which have storage for imaged printing plates or print samples, for tools, and for measuring means and supplies.

For space and manufacturing-related reasons, equipment which is not primarily intended for the control or regulation of operating processes is contained in separate housings. Examples are register dies, devices for the production of printing forms, and printing-plate scanners. For simplification of the preparation of a printing form, an arrangement is described in German Patent No. 43 06 677 C2 in which a register die and a plate scanner are housed in one device.

In devices of different manufacturers which are combined, operation in most cases is not uniform, and frequently there is no compatibility of the control data. In addition, several individually installed components require more material and a larger installation area. The transport of data and material between the components is difficult and susceptible to faults.

SUMMARY OF THE INVENTION

An objective of the present invention is to develop a control desk which, while having a low space requirement and being economical in materials and costs, combines a multiplicity of functions while reducing the influence of external disturbance variables acting on it.

The present invention provides a control desk for a printing press with operating and display elements for the control of operating processes of the printing press, characterized in that a device (14) for the production of printing forms is integrated therewith.

A series of advantages arises as a result of the control desk having at least one device for the production of printing forms integrated in it: By avoiding a separately installed device for production of printing forms, less setup space and less extensive building modification are needed. Multiple power supply devices and computer means do not have to be provided. The operating and display elements of the control desk serve both for the control of the printing press and for the control of operating procedures in the production of the printing form. The operation of all components is simplified because the user interface for all operating elements is made uniform. Monitoring of the production of printing forms and of the printing press itself can be realized with an integrated data concept. Along with the device for the production of printing forms, a device for the production of proof impressions can be integrated in the control desk.

The computer means for control can be connected to a print-shop network whereby job-related data on the customer, number of copies, type of paper to be used, and due date can be transferred from a production control computer to a control computer located in the control desk. Likewise data which is needed for imaging of the printing forms and for presetting of the printing press can be transferred from a computer of the print preparation department.

The handling of the printing forms becomes less susceptible to interference. The need for auxiliary devices such as job pockets, delivery containers, and data cassettes is eliminated.

BRIEF DESCRIPTION OF THE DRAWING

The present invention will be explained in greater detail below using the drawing, in which.

DETAILED DESCRIPTION

Figure 1:
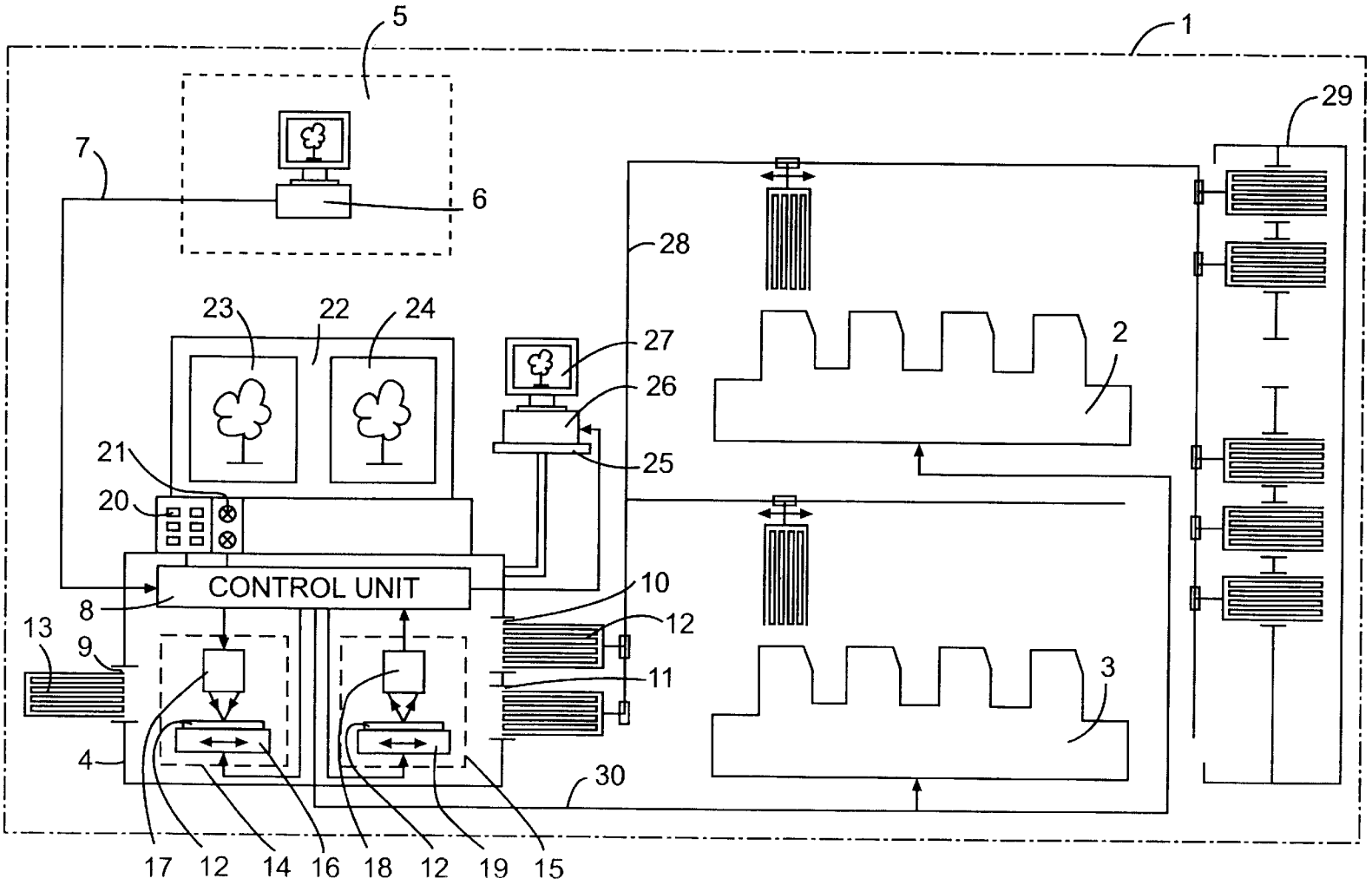
FIG. 1 shows an example of an embodiment of the control desk of the present invention.

FIG. 1 shows a print shop 1 with two printing presses 2,3, a control desk 4, and a preprint department 5 schematically depicted. A layout computer 6 of the preprint department 5 is connected with a control unit 8 through a network 7. Control unit 8 contains at least hardware for a computer, digital storage elements, a program system for implementation of several functions, and interfaces and/or components for input and output of data and/or signals. An input station 9 and two output stations 10,11 for printing plates 12 are provided at control desk 4. Printing plates 12, one for each print image, are each located in a dust-tight cassette 13. Within control desk 4, a device 14 for the preparation of printing forms and an image recording system 15 are installed. Device 14 is connected to control unit 8, and contains a processing table 16 for a printing plate 12 which can be positioned in three coordinate directions. A laser 17 can be focused on a printing plate 12 which is held on processing table 16, with the energy in the focus being sufficient to generate pixels on the surface of printing plate 12. Image recording system 15 contains a camera 18, and an imaged printing plate 12 can be positioned with respect to camera 18 for scanning in at least two directions with the aid of a measuring table 19.

In one variant, which is not further depicted, several devices 14 for the production of printing forms can be provided within control desk 4 for simultaneously imaging several printing plates 12. It is likewise possible to structurally unite device 14 for printing-form production with image recording system 15 within control desk 4 so that processing table 16 at the same time is measuring table 19. Printing plate 12 can be handled within control desk 4 so that for the purposes of an incoming inspection, non-imaged printing plate 12 is brought to image recording system 15, then to device 14 for production of printing form, and then back to image recording system 15 for a final inspection. The conveyor for handling can transport printing plates 12 in straight lines or in circular paths.

Also provided on control desk 4 are operating elements 20 and display elements 21. As shown in FIG. 1, operating elements 20 and display elements 21 are connected to control unit 8. A holder 22 for a test sample 23 and for an OK sample 24 is located on control desk 4. A computer 26 with a monitor 27 is on a console table 25 connected to control desk 4. Control desk 4 is linked to printing presses 2,3 and storage system 29 through a conveyor system 28. In addition, control desk 4 is connected to printing presses 2,3 through control lines 30. More specifically, as shown in FIG. 1, control lines 30 are connected to control unit 8.

Control desk 4, through control unit 8, serves both for the control of at least one of printing presses 2,3 and for the control of the process of imaging printing plate 12 and the process of obtaining image signals with the aid of image recording system 15. The image data, of the print image generated on layout computer 6 in preprint department 5 is transmitted through network 7 to the computer of control unit 8.

Unimaged printing forms 12 are in cassette 13 at input location 9. Printing forms 12 can be preconditioned in cassette 13 for which purpose, by way of example, they are brought to a certain temperature or are maintained in a certain humidity. During the transport of a printing plate 12 from input location 9 to processing table 16, additional processing steps which are required for preparation for imaging can follow. Examples are cleaning and coating of printing plates 12 which are to be imaged. Imaging of printing plate 12 is performed pixel by pixel, with processing table 16 performing positioning steps which are perpendicular to the optical axis of the beam from laser 17. Printing plate 12 can additionally be positioned in the direction of the optical axis for focusing the beam. Laser 17 is modulated according to the image data. For this purpose, the image data originating in computer 6 can be processed into imaging data in control unit 8. Through the imaging, pixels which are ink-receptive or ink-repellent are created on the surface of printing plates 12. Simultaneously with the imaging, image data reproducing the surface can be obtained from a printing plate 12 which is located on measuring table 19 with the help of camera 18 and the image data can be sent to control unit 8. Control unit 8 contains a computer for image analysis and target-to-actual comparison on a pixel-by-pixel basis, by which quality control of the imaging is possible. The image recording system and the computer 8 thus form a quality control system. The image data of a set of printing plates 12 associated with a print image can be supplied to computer 26 which contains a program for generating a print image on monitor 27. It is therefore possible for the operator of printing press 2,3 to visually check whether printing plates 12 are properly imaged.

In addition to the generation of a so-called soft proof, a device for generation of a proof or test impression can be connected to control desk 4 or integrated into control desk 4.

Following quality control, printing plates 12 associated with a print image are deposited in cassettes 13 which are docked at output locations 10, 11 for further transport of printing plates 12 to printing presses 2,3. These output locations 10, 11 function as storing devices. A conveyor system 28 is provided for further transport. Cassettes 13 are transported over guide rails, depending on their destination, to the printing mechanisms of printing presses 2, 3 or to storage systems 29. For jobs which are to be printed in sequence, temporary storage for printing plates 12 can be provided in control desk 4. If a job is to be printed repeatedly, the set of printing plates 12 associated with the job can be pulled from storage system 29.

Printing plates 12 for a job are brought to a system for automatic plate feed to the particular print mechanism of printing presses 2,3 where they are mounted on the particular printing-form cylinder in the preparation phase for printing. The image data from computer 6 and the image data from the surface of imaged printing plates 12 are used, along with data referring to printing presses 2,3, printing stock, printing ink, and other process variables, for presetting printing presses 2, 3 and units connected to printing presses 2,3. Printing presses 2, 3 are controlled with the help of operating elements 20 and display elements 21 from control unit 8 of control desk 4. A portion of operating elements 20 and display elements 21 is provided for controlling operating processes in the imaging of printing plate 12 and in capturing image data which represent the print image.

What is claimed is:

1. An integrated control desk for a printing system having at least one printing press, comprising:

operating and display elements of the control desk for the control of operating processes of the printing system;

a production device for the production of printing forms used in the at least one printing press, said production device being integral with the control desk; and a control unit electrically connected to the operating and display elements and to the production device, the control unit being adapted to form an image on the printing forms in the production device, and to control with the operating and display elements the at least one printing press.

2. The integrated control desk as recited in claim 1 further comprising an input location for unimaged printing forms and at least one storing device for storing imaged printing forms associated with a print image, and wherein the printing form production device includes an imaging system for the imaging of printing forms.

3. The integrated control desk as recited in claim 2 wherein the production device is linked to a device for the transport of the imaged printing forms to the printing press.

4. The integrated control desk as recited in claim 2 further comprising a quality control device for the imaged printing forms, the quality control device being assigned to the imaging system.

5. The integrated control desk as recited in claim 4 wherein a color monitor screen is assigned to the control desk for visualization of the imaging.

6. The integrated control desk as recited in claim 1 further comprising a device for generation of a test impression.

7. The integrated control desk as recited in claim 1 wherein image data reproducing the print image can be retrieved through a bus of a computer network connected to the production device.

* * * * *